US005579945A

United States Patent [19]

Ichikawa et al.

[11] Patent Number: 5,579,945

[45] Date of Patent: Dec. 3, 1996

[54] CONTAINER HOUSING CONTAINING DISPOSABLE CONTAINER

[75] Inventors: Toru Ichikawa, Misato; Tomio Tahara, Tokyo, both of Japan

[73] Assignee: Hosokawa Yoko Co., Ltd., Tokyo, Japan

[21] Appl. No.: 498,726

[22] Filed: Jul. 26, 1995

Related U.S. Application Data

[63] Continuation of Ser. No. 236,555, May 2, 1994, abandoned.

[30] Foreign Application Priority Data

Aug. 23, 1993 [JP] Japan ..... 5-050105 U

[51] Int. Cl.[6] ..... B65D 77/00

[52] U.S. Cl. ..... 220/403; 220/462; 220/410; 220/461; 222/105; 229/125.15

[58] Field of Search ..... 220/453, 462, 220/410, 461, 105; 229/125.15

[56] References Cited

U.S. PATENT DOCUMENTS

| | | | |
|---|---|---|---|
| 2,793,669 | 5/1957 | Clarke | 220/403 |
| 3,000,492 | 9/1961 | Miller . | |
| 3,018,030 | 1/1962 | Schnee . | |
| 3,370,774 | 2/1968 | Hopf . | |
| 3,819,036 | 6/1974 | Weldon . | |
| 4,524,883 | 6/1985 | Herring | 220/462 |
| 4,615,476 | 10/1986 | Hobbs et al. . | |
| 4,635,814 | 1/1987 | Jones | 220/461 |
| 5,156,299 | 10/1992 | De Caluwe et al. . | |
| 5,169,026 | 12/1992 | Patterson . | |
| 5,203,470 | 4/1993 | Brown . | |

FOREIGN PATENT DOCUMENTS

| | | |
|---|---|---|
| 9216132 | 10/1992 | European Pat. Off. . |
| 7825020 | 8/1978 | Germany . |
| 3833663A1 | 10/1988 | Germany . |
| 123561 | 7/1989 | Japan . |
| 1330449 | 9/1973 | United Kingdom . |
| 1571493 | 7/1980 | United Kingdom . |
| WO91/01104 | 2/1991 | WIPO . |

OTHER PUBLICATIONS

Patent Abstracts of Japan vol. 018, No. 274 (M-1611), May 24, 1994 JP-A-06 048465, Feb. 22, 1994.

Examiner's report to the Controller under Section 17 dated Sep. 27, 1994.

*Primary Examiner*—Joseph M. Moy

*Attorney, Agent, or Firm*—Kane, Dalsimer, Sullivan, Kurucz, Levy, Eisele and Richard

[57] ABSTRACT

A container comprising a combination of a flexible inner container and a hard outer housing for holding the inner container therein is disclosed. The flexible inner container comprises a cylindrical mouth for dispensing contents of the container. The cylindrical mouth comprises a passage for pouring the content and engagement grooves provided on both sides of the outer periphery of the mouth with respect to the passage. The hard outer housing comprises four side walls one of which has a large opening, an upper wall having a pair of guide portions sandwiching a guide notch which is opened to the large opening of the outer housing and extends to approximately the center of the outer housing, and a supporting member for supporting the container which projects in the outward direction of the flexible inner container and which is connected to the ends of the guide portions in the side of the large opening.

21 Claims, 6 Drawing Sheets

CONTAINER HOUSING CONTAINING DISPOSABLE CONTAINER

This is a continuation of application Ser. No. 08/236,555 filed on May 2, 1994 now abandoned.

BACKGROUND OF THE INVENTION

1. Industrial Field of the Invention

The present invention relates to a container comprising a combination of a flexible inner container and an outer housing for supporting the container. In particular, the present invention relates to a type of container in which a flexible inner container has a projecting outlet at the top portion thereof and the contents of the container can be dispensed by tilting the container. The flexible inner container is generally used only once and is then thrown away, and the outer housing is generally used repeatedly.

2. Related Art

Containers for liquid detergents, cooking oils, liquid condiments, and the like, for home use are generally used only once and are then thrown away. However, since such waste poses environmental problems of environmental pollution, it is generally desired to decrease the quantity of such waste by using bag-like containers formed of a flexible film material.

Since such flexible containers are difficult to stand upright and are not stable, a container in which a flexible container is supported by a stiff outer housing in order to stand the flexible container erect,and so that the contents can be dispensed through a dispenser, has been proposed (see Japanese Utility Model Application Kokoku (Post-Exam Publication) No. Hei 1-23561). In this container, a dispenser projecting outside the outer housing in the upward direction is attached to the flexible container, and the contents therein is dispensed by pumping with a finger. Generally, the dispenser and the outer housing are repeatedly used, and the flexible inner container, however, is used only once and then thrown away.

Most containers for liquid detergents, cooking oils, liquid condiments, and the like, for home use have a large capacity, e.g., a capacity of 1 liter or more. Such a container may be formed by using a flexible film material in order to decrease the quantity of waste and by using no dispenser in order to reduce the cost thereof. In this case, the flexible container is included in a stiff outer housing and has a projecting outlet at the top portion thereof, and the contents of the flexible container can be dispensed by tilting the outer housing.

Such a container is convenient for home use. For example, use of such a container enables pouring a large quantity of a cooking oil or the like into a pan. According to the container having a double structure with a dispenser, the contents therein can be dispensed in a state of the container standing erect on a table or the like by using the outer housing. However, when an outer housing with a simple cylindrical or box shape is used, it is inconvenient and it is difficult to lift and tilt the outer housing container holding a large and heavy flexible inner container. Furthermore, there is a possibility that a hand of a person may make contact with the liquid contents which has dripped on the outer surface of the outer housing, and there is therefore a possibility of the container being dropped.

SUMMARY OF THE INVENTION

The present invention was developed in view of the above-described problems in conventional containers of this type.

It is therefore, an object of the present invention to provide an improved container which comprises a combination of a flexible inner container and an outer housing container for supporting the container and is a type of a container in which the flexible inner container has a projecting outlet at the top portion thereof and the contents of the container can be dispensed by tilting the container.

Another object of the present invention is to provide an improved container being suitable for home use, in which the contents therein can be easily dispensed by tilting the container, without the possibility of a hand of a person holding the container contacting the liquid contents, even if the container is large and heavy.

In order to achieve the above-described objects, the container of the present invention comprises: a flexible inner container which comprises a cylindrical mouth for dispensing contents of the container, in which the cylindrical mouth projecting in the upward direction is provided at the top of the flexible inner container, and the cylindrical mouth comprises a passage for communicating the inside and the outside of the container and engagement grooves provided on both sides of the outer periphery of the mouth with respect to the passage; and a hard, stiff outer housing which comprises three side walls and a side having a large opening, and an upper wall having a pair of guide portions sandwiching a guide notch which is opened in the direction of the large opening of a side of the outer housing and extends to approximately the center of the outer housing, each of the pair of guide portions having a stopper member for preventing separation of the flexible inner container from the place in the outer housing at a predetermined position facing the guide notch; wherein the flexible inner container is inserted into the outer housing through the large opening of the outer housing and is held by the outer housing, by interfitting the pair of guide portions into the engagement grooves of the cylindrical mouth, and projecting the mouth in the upward direction.

The flexible inner container is inserted into the outer housing through the large opening of the outer housing and is held by the outer housing, by interfitting inner side portions of the upper wall facing the guide notch into the grooves for engagement provided on both sides of the mouth, projecting the cylindrical mouth in the upward direction. Accordingly, it is possible not only to decrease the quantity of disposed waste, but it is also possible to very easily insert the flexible inner container into the outer housing, independent of the shape or the pliantness of the inner container, and to stably hold the inner container erect. It is possible to provide an improved container appropriate for home use in which the contents therein can be easily dispensed, even if the container is large and heavy.

Preferably, the container of the present invention comprises: a flexible inner container which comprises a cylindrical mouth for dispensing contents of the container, in which the cylindrical mouth projecting in the upward direction is provided at the top of the flexible inner container, and the cylindrical mouth comprises a passage for communicating the inside and the outside of the container and engagement grooves provided on both sides of the outer periphery of the mouth with respect to the passage; and a hard outer housing which comprises three side walls and a side having a large opening, an upper wall having a pair of guide portions sandwiching a guide notch which is opened in the direction of the large opening of the outer housing and extends to approximately the center of the outer housing, the upper wall further having an inclined surface in the side opposite to the large opening the height of which is low as the position thereof is near the side wall opposite to the large opening, and each of the pair of guide portions having a pair of stopper for preventing separation of the flexible inner container from the place in the outer housing at a predetermined position facing the guide notch, and a supporting member for supporting the container which projects in the outward direction of the flexible inner container and is connected to the ends of the guide portions in the large opening; wherein the flexible inner container is inserted into the outer housing through the large opening of the outer housing and is held by the outer housing, by interfitting the pair of guide portions into the engagement grooves of the cylindrical mouth, and projecting the mouth in the upward direction.

Accordingly, it is possible to provide a container having a double structure and which is suitable for home use, in which the contents therein can be easily dispensed without the possibility of the liquid contents thereof coming into contact with the hand of the person holding the container, even if the container is large and heavy.

Preferably, the supporting member has a pair of ears which horizontally project in the outward direction of the large opening of the outer housing.

In such a structure, since ears extending to the outside of an large opening wall are provided in upper portions of the front wall and rear wall which sandwich a guide notch of the outer housing, when the container is lifted up by grasping the ears, a torque is generated by the weight of the contents of the flexible inner container, which lowers the side wall which is positioned opposite to the ears. Therefore, it is possible to dispense a large amount or the desired amount of the contents by the container in a naturally tilted state, even if the container including the contents is large and heavy. The contents are dispensed from the side opposite to the ears through the passage, and the hand of a person holding the container is at a position higher than that of the passage and outside the outer housing; therefore the contents do not adhere to the hand of the person. Therefore, it is possible to handle the container without it slipping due to the contents making the outside of the container slippery.

The pair of end portions of the supporting member in the side of the large opening can be provided so as to project on the surface of the side wall having the large opening of the outer housing, and preferably, a hole for hanging up on a wall is formed in a portion of the end portions. Thereby, it is possible not only to decrease the quantity of waste to be disposed of due to the container having a double structure, but also to very easily insert the flexible inner container into the outer housing independent of the shape or the softness of the inner container, and to use the contents thereof, e.g., a shampoo, a detergent or the like, in the inner container in the state in which the container is hanging on, for example, on a wall, e.g., on a wall of a shower room. It is possible to provide an improved container being suitable for home use in which the contents therein can be easily dispensed, even if the container is large and heavy.

DETAILED DESCRIPTION OF THE PRESENT INVENTION

Hereinafter, an embodiment of the present invention will be explained with reference to the attached drawings. A first embodiment of the container according to the present invention will be explained in detail in conjunction with FIGS. 1–4, as follows.

Figure 1:
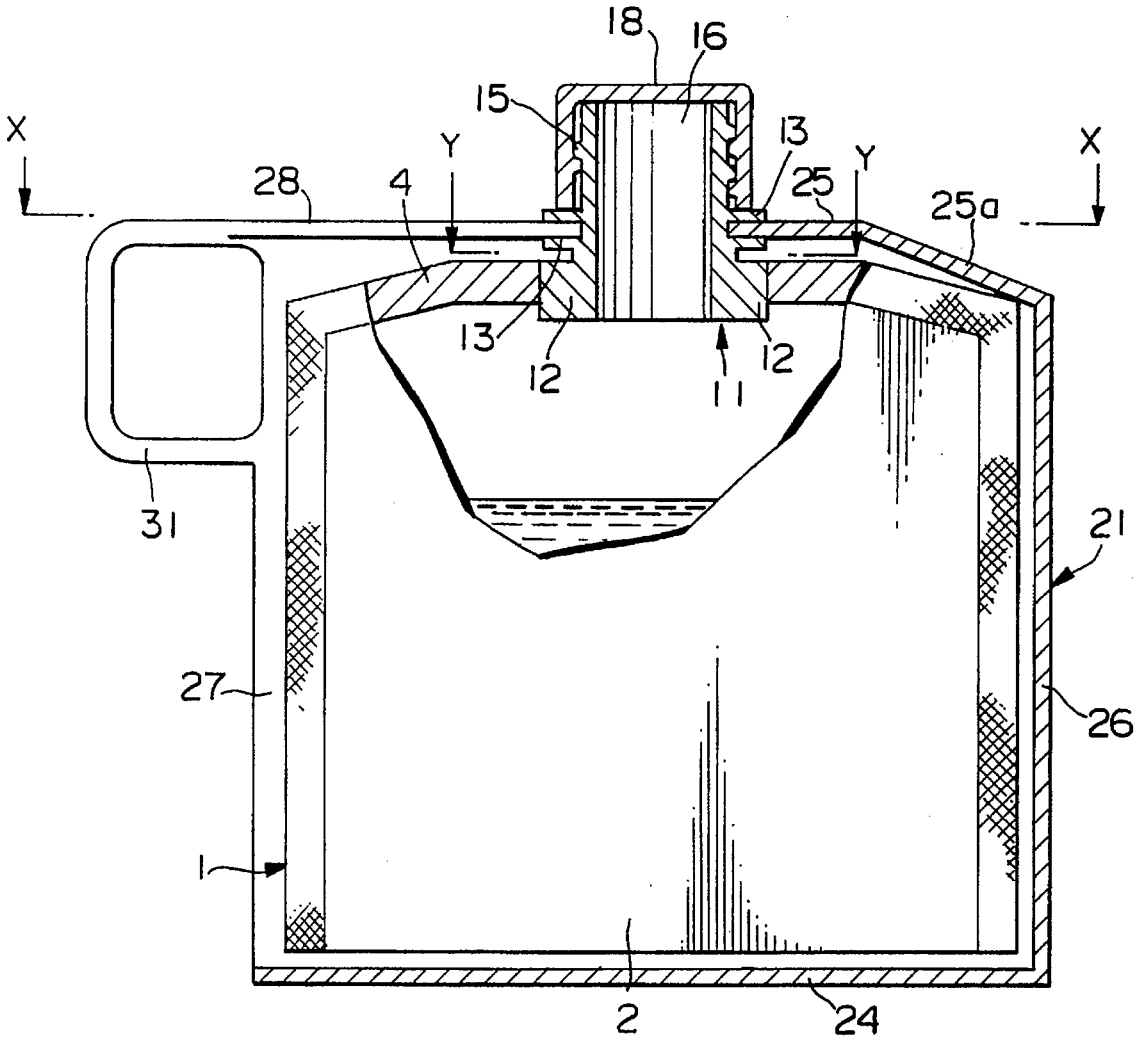
FIG. 1 is a partially cutaway longitudinal sectional view showing a first embodiment of the present invention.
Figure 2:
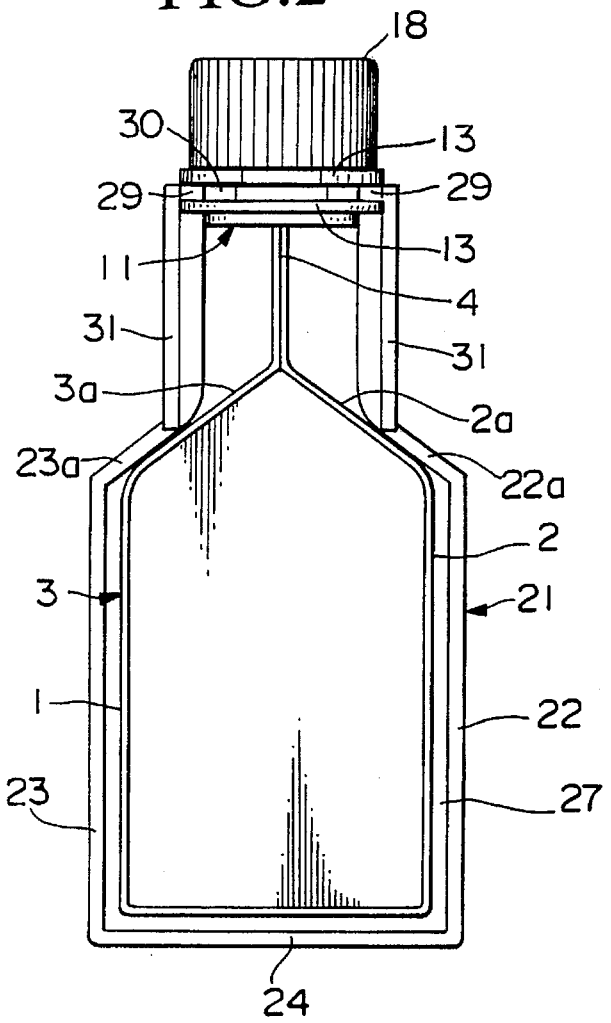
FIG. 2 is a left side view of the embodiment shown in FIG. 1.
Figure 3:
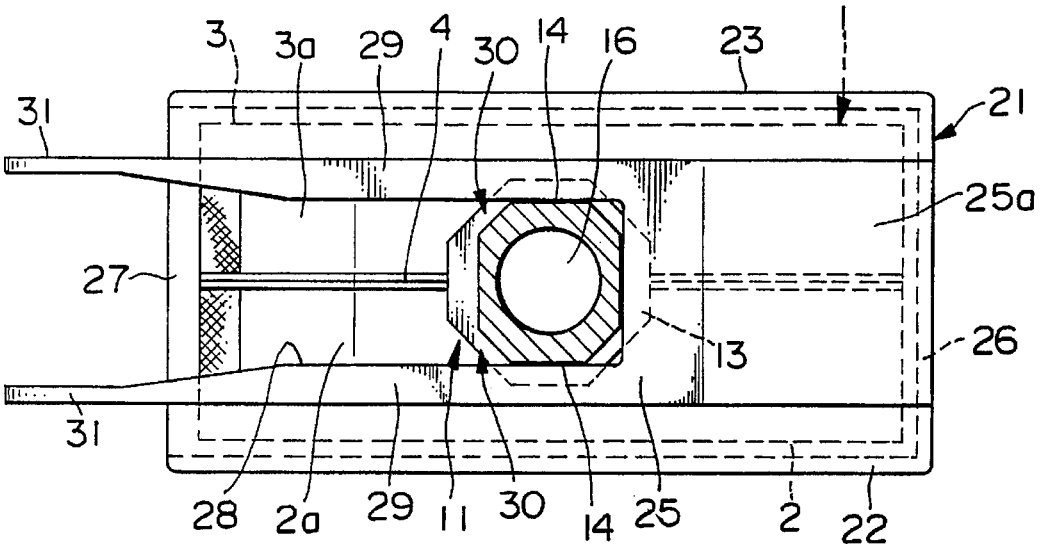
FIG. 3 is a sectional view taken along line X—X of FIG. 1.

The container of the embodiment comprises a flexible inner container 1 and a hard stiff outer housing 21 including the flexible inner container 1 therein. The flexible inner container 1 is formed in a box-shape and is rectangular in plan view; it is made of a flexible film material, e.g., a plastic film; or a material made by laminating a metal foil, a paper, a cellophane, or a suitable combination thereof on a plastic film, as shown in FIGS. 1 and 2. The flexible inner container 1 has a seal portion 4 which is formed by putting the two flush together, and melting or otherwise adhering the top portions of the front wall 2 and the rear wall 3 of the container 1 along the long dimension of the rectangle. A cylindrical mouth 11 is attached to the seal portion 4 at the central portion thereof.

Figure 4:
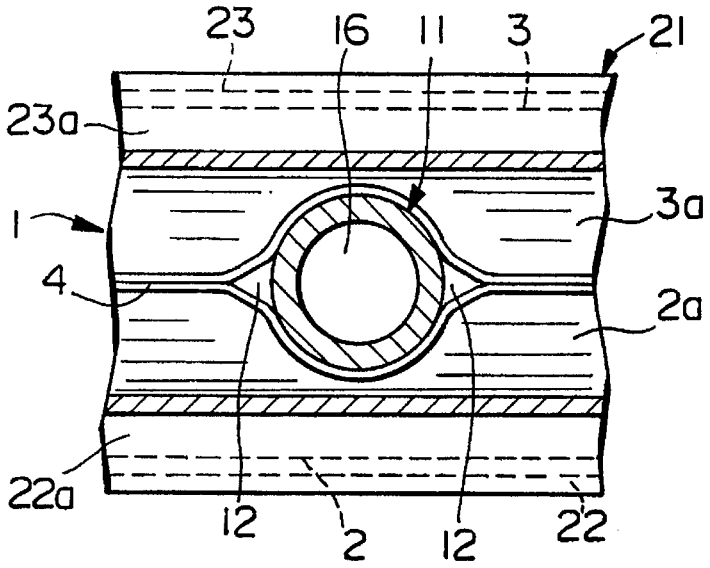
FIG. 4 is a sectional view taken along line Y—Y of FIG. 3.

The cylindrical mouth 11 is made of a hard plastic material. The cylindrical mouth 11 has tongue portions 12 with pointed heads which project in outer opposite directions and are provided at opposite sides to each other with respect to the center of the mouth 11 on the base portion thereof sandwiched by the seal portion 4. The front wall 2 and the rear wall 3 of the container 1 are connected to each other so as to form a hermetic seal, to the side of walls of the tongue portions 12, and to the peripheral wall of the cylindrical mouth 11 by melting or adhering, as shown in FIG. 4. The cylindrical mouth 11 has two flange portions 13 and 13 with a little space at portions above the connected portion of the front wall 2 and the rear wall 3. Portions in the little space between the two flange portions, which sandwich the center of the cylindrical mouth 11 and which face to the sides of the front wall 2 and the rear wall 3 of the container 1, form engagement grooves 14 and 14. The mouth 11 has a screw 15 for putting on a cap 18, on the outer periphery of an upper portion. A hollow portion (passage) 16 passing through the mouth 11 in a vertical direction functions as a mouth.

The outer housing 21 is made of a hard plastic or the like, and has a size and a shape into which the flexible inner container 1 can be completely inserted. The outer housing 21 comprises a front wall 22 and a rear wall 23 which are positioned in the long sides thereof, a bottom wall 24, an upper wall 25, and a side wall 26 which is positioned along one of the short sides thereof. The other of the short sides of the outer housing 21 is open. The upper wall 25 has a guide notch 28 which is opened in the direction of the large opening 27 of the outer housing 21 and which extends to approximately the center portion of the outer housing 21. Stopper projections 30 and 30 opposed to each other are provided on the inner side of a pair of guide portions 29 and 29 of the upper wall which face the guide notch 28. The upper wall 25 in the side opposite to the large opening 27 has an inclined top surface 25*a* in which the height of a position of the inclined surface is smaller the smaller the distance between the position and the side wall 26 opposite to the opening is.

The flexible inner container 1 has two inclined shoulder walls 2*a* and 3*a* between the front wall 2 and the joined portion (the seal portion) 4, and between the rear wall 3 and the joined portion 4, respectively. The front wall 22 and the rear wall 23 of the outer housing 21 have two inclined walls 22*a* and 23*a* which are approximately parallel to the inclined shoulder walls 2*a* and 3*a* of the inner container 1, respectively. The front wall 22 and the rear wall 23 have two extending portions in positions above the inclined walls 22*a* and 23*a* which extend in the direction of the outside of the large opening 27 and are parallel to each other. An ear 31 having an opening for laying a finger is formed in the vicinity of the end of each extending portion. The pair of ears 31 and 31 form a supporting member for supporting the container.

The flexible inner container 1 is inserted into the outer housing 21 through the large opening 27 thereof by interfitting inner side of the pair of guide portions 29 and 29 of the upper wall of the outer housing 21 into the engagement grooves 14 and 14 of the flexible inner container 1 and transferring the cylindrical mouth 11 along the guide notch 28. The cylindrical mouth 11 is transferred to the inner end of the guide notch 28 after passing the stopper projections 30 and 30. Consequently, the flexible inner container 1 is completely included in the outer housing 21. The cylindrical mouth 11 projects in the upward direction from the upper wall 25. Separation of the flexible inner container 1 from the predetermined position in the outer housing 21, i.e., from the inner end position of the guide notch 28, is prevented by the stopper projections 30 and 30. Thus, the flexible inner container 1 is stabilized in the outer housing 21 by hanging from the pair of guide portions 29 and 29 of the upper wall of the outer housing 21.

When the cap 18 is removed to open the hollow portion 16 and the outer housing 21 having the flexible inner container 1 therein is lifted up by a finger laid on the ears 31 and 31, a torque is generated by the weight of the contents of the flexible inner container 1, which lowers the side wall 26 which is positioned in the side opposite to the ears 31. Therefore, the contents can be dispensed in the side opposite to the ears 31 through the hollow portion 16 by stopping the rotation of the container at an appropriate angle by firmly holding the ears 31 and 31, or by further tilting the container at an angle larger than that obtained by the torque. Accordingly, even if the contents drip on the outer surface of the outer housing 21, the contents do not adhere to the hand of the person holding the container.

When the contents of the flexible inner container 1 have been consumed, the empty inner container 1 is separated from the outer housing 21 by transferring the cylindrical mouth 11 to the large opening 27 along the guide notch 28. Thereafter, a new flexible inner container 1 filled with contents is inserted into the outer housing 21.

In the embodiment, since the flexible inner container 1 is compactly inserted into the outer housing 21 leaving a little space between the front wall 22 of the outer housing 21 and the inner container 1, between the rear wall 23 and the container 1, and between the one side wall 26 and the container 1, and the inner side of the pair of guide portions 29 and 29 of the upper wall of the outer housing 21 are interfitted into the engagement grooves 14 and 14, movements of the inner container 1 in the forward and rearward directions, in the direction of the one side wall 26, and in the upper and lower directions, are regulated by the outer housing 21. Furthermore, since the large opening 27 is closed by a hand holding the ears 31 and 31, when the housing 21 with the inner container 1 is lifted up in order to dispense the contents, the inner container 1 cannot shift by a significant amount in the outer housing 21 and cannot escape from the outer housing 21. Therefore, it is possible to reliably handle the housing 21 containing the inner container 1.

Since the front wall 22 and the rear wall 23 of the outer housing 21 have the inclined walls 22*a* and 23*a* which are corresponding to the inclined shoulder walls 2*a* and 3*a* of the flexible inner container 1, respectively, it is possible to further reduce the space therebetween to improve stability. Since the space between the two ears 31 and 31 which extend in a horizontal direction of the outside of the large opening 27 and which are provided in upper position, is small, the two ears 31 and 31 provide a construction for easy handling. Furthermore, since the upper wall 25 of the outer housing 21 has the inclined top surface 25*a*, when the contents of the container 1 is transferred into a pan or the like, it is possible to pour the contents into the pan or the like, without spilling the contents, by bringing the inclined top surface 25*a* near or in contact with the pan or the like and sticking the hollow portion 16 into the above position inside the pan or the like.

The inclined walls 22*a* and 23*a*, and the inclined top surface 25*a* of the outer housing 21, are not all essential in order to achieve the objects of the invention. However, the outer housing 21 is required to have a rigidity sufficient not to compress the inner container 1 and not to largely curve the front wall 22 and the rear wall 23 of the outer housing 21 to bring near each other when the two ears 31 and 31 are grasped.

Figure 6:
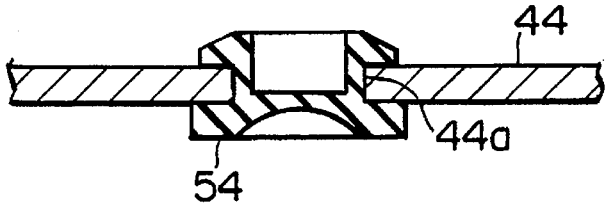
FIG. 6 is a sectional view showing an embodiment of a member for preventing to slip.

Next, a second embodiment of the container according to the present invention will be explained in detail in conjunction with FIGS. 5A–6, as follows. In the second embodiment, a flexible inner container 1 similar to that of the first embodiment may be used, as shown in FIG. 5B.

Figure 5A:
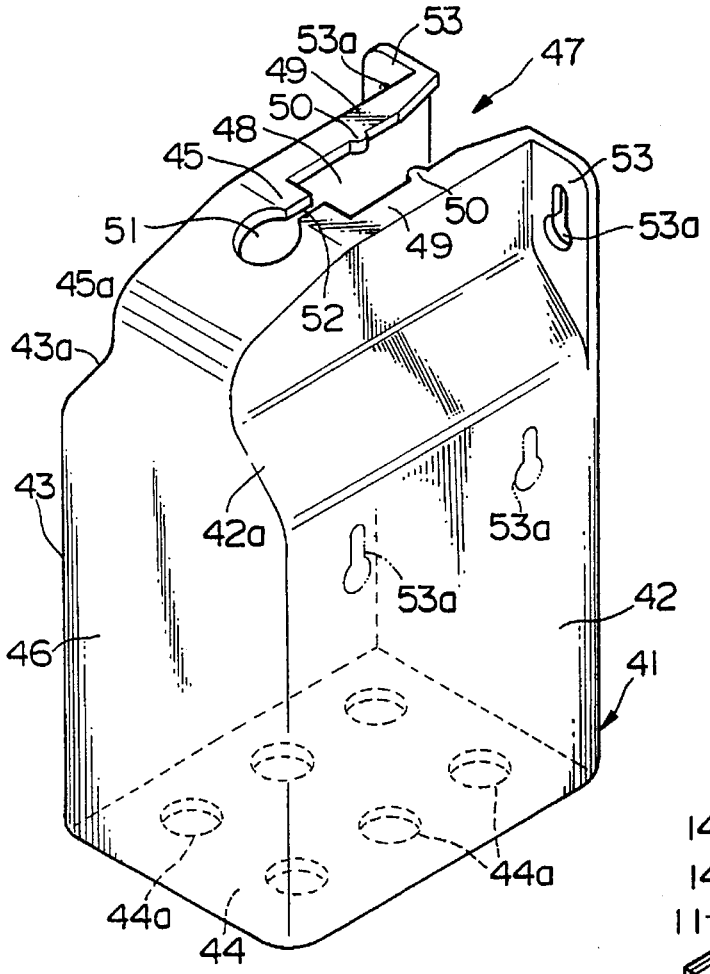
FIG. 5A is a perspective view showing an outer housing in a second embodiment of the present invention.
Figure 5B:
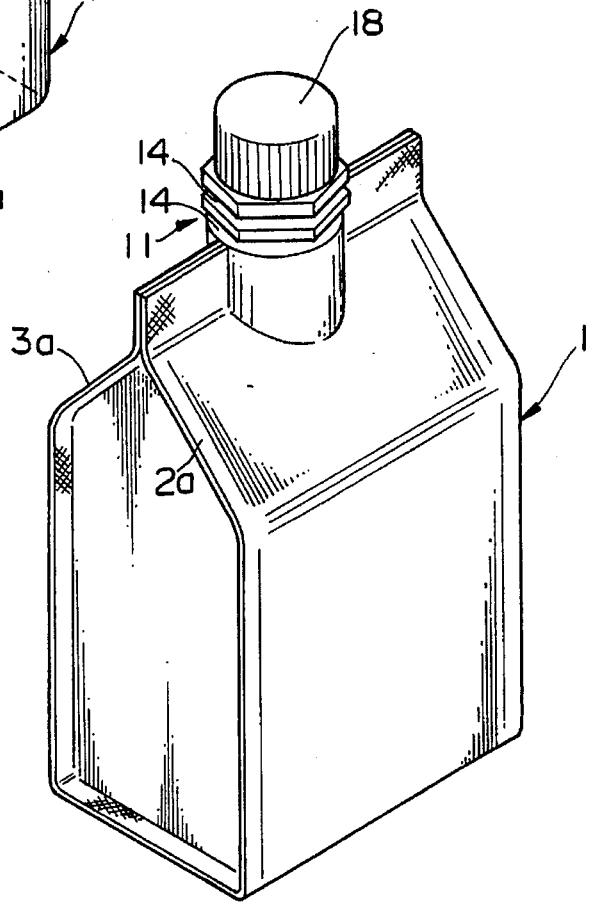
FIG. 5B is a perspective view showing a flexible inner container in a second embodiment of the present invention.

In FIG. 5A, the outer housing 41 is made of a hard plastic or the like, and has a size and a shape into which the flexible inner container 1 can be completely inserted. The outer housing 41 comprises a front wall 42 and a rear wall 43 which are positioned in the long sides thereof in plan view, a bottom wall 44, an upper wall 45, and a side wall 46 which is positioned in one of the short sides thereof in plan view. The other side wall of the short sides of the outer housing 41 has a large opening 47. The upper wall 45 has a guide notch 48 which is open in the large opening 47 of the outer housing 41 and which extends to approximately the center portion of the outer housing 41. A pair of stopper projections 50 and 50 opposed to each other are provided on inner side of a pair of guide portions 49 and 49 of the upper wall 45 which sandwich the guide notch 48. The upper wall 45 in the side opposite to the large opening 47 has an inclined top surface 45*a*, in which the height of a position of the inclined surface 45*a* is smaller the smaller the distance between the position and the side wall 46 opposite to the opening 47 is. At a position of the upper wall 45 adjacent the center of the inner end of the guide notch 48, a hole 51 connecting to the guide notch 48 through a slit 52 is formed so that the hole 51 and the slit 52 facilitate elastic deformation of the outer housing 41 when the flexible inner container 1 is inserted into the outer housing 41.

The front wall 42 and the rear wall 43 of the outer housing 41 have two inclined walls 42*a* and 43*a* which have angles corresponding to that of the inclined shoulder walls 2*a* and 3*a* of the inner container 1, respectively. At the ends of the pair of guide portions 49 and 49 of the upper wall 45 in the side of the large opening 47, a pair of projecting walls 53 and 53 which project to the lateral external directions parallel to the opposite side wall 46, is provided. The pair of projecting walls 53 and 53 form a supporting member. At approximately the center of each projecting wall 53, a hole 53*a* is formed for hanging the container on a wall. The pair of holes 53*a* and 53*a* for hanging may be formed in at least one of the front wall 42 and the rear wall 43 of the outer housing 41. The bottom wall 44 has a plurality of through holes 44*a* for draining water out of the outer housing 41. These plurality of through holes 44*a* can be used as holes for attaching a plurality of members 54 for preventing to slip which are made of a material having a large coefficient of friction, e.g., rubber or the like, by interfitting them into the through holes 44*a*, as shown in FIG. 6. Accordingly, it is possible to make the container difficult to slip and it is possible to use it stably when the container is used by placed on a table or a floor.

The flexible inner container 1 is inserted into the outer housing 41 through the large opening 47 thereof by interfitting the inner side of the pair of guide portions 49 and 49 of the upper wall of the outer housing 41 into the engagement grooves 14 and 14 of the flexible inner container 1 and transferring the cylindrical mouth 11 along the guide notch 48. The cylindrical mouth 11 is transferred to the inner end of the guide notch 48 after passing the pair of stopper projections 50 and 50. Since the hole 51 connecting to the guide notch 48 through the slit 52, which can facilitate elastic deformation of the outer housing 41, are provided adjacent the center of the inner end of the guide notch 48, the cylindrical mouth 11 can be easily transferred to the predetermined position over the pair of stopper projections 50 and 50. Consequently, the flexible inner container 1 is completely included in the outer housing 41. The cylindrical mouth 11 projects in the upward direction from the upper wall 45. Separation of the flexible inner container 1 from the predetermined position in the outer housing 41, i.e., from the inner end position of the guide notch 48, is prevented by the stopper projections 50 and 50. Thus, the flexible inner container 1 is stabilized in the outer housing 41 by hanging from the pair of guide portions 49 and 49 of the upper wall of the outer housing 41. Then, the outer housing 41 with the flexible inner container 1 in the side of the side wall 46 is grasped, and hung on a pair of screws, pins or hooks provided on a wall, e.g., on a wall of a shower room, of a bathroom, of a lavatory or the like, through the holes 53*a* of the pair of projecting walls 53 and 53 of the outer housing 41. Water from the shower or the like which entered in the outer housing 41 through the guide notch 48, the hole 51 or the like can be drained out through the plurality of through holes 44*a* formed in the bottom wall 44.

Figure 8A:
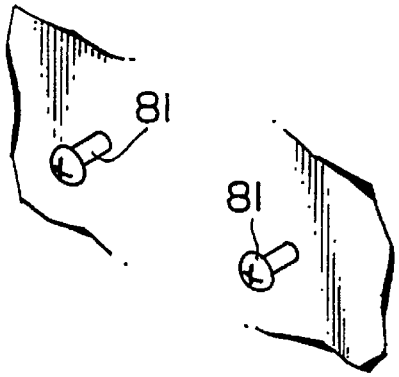
FIG. 8A is a perspective view showing an embodiment of a pair of screws or the like attached to a wall.
Figure 8B:
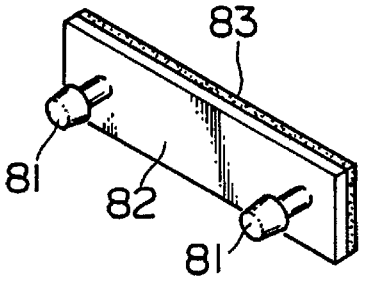
FIG. 8B is a perspective view showing another embodiment of a pair of screws or the like attached to a wall.

The pair of screws, pins or hooks 81 and 81 provided on a wall of a shower room, of a bathroom, of a lavatory or the like, may be attached directly to the wall, as shown in FIG. 8A. The pair of screws or the like 81 and 81 may be also attached to the wall by adhering an attachment 82 which has the pair of screws or the like 81 and 81 fixed on the front surface of the attachment 82 and a pressure sensitive adhesive double coated tape adhered on the rear surface thereof, to the wall, as shown in FIG. 8B.

After the container is removed from the screws, pins or hooks 81 and 81 provided on the wall, the cap 18 is taken off to open the hollow portion, and the outer housing 41 having the flexible inner container 1 therein is lifted up by grasping the outer housing 41 at the side having the large opening 47. Accordingly, a torque lowering the side wall 46 is generated by the weight of the contents of the flexible inner container 1. Therefore, the contents can be dispensed from the side of the large opening 47 through the hollow portion 16, in a manner similar to that of the first embodiment. Accordingly, even if the contents drips on the outer surface of the outer housing 41, the contents do not adhere to the hand of the person holding the container.

Figure 7:
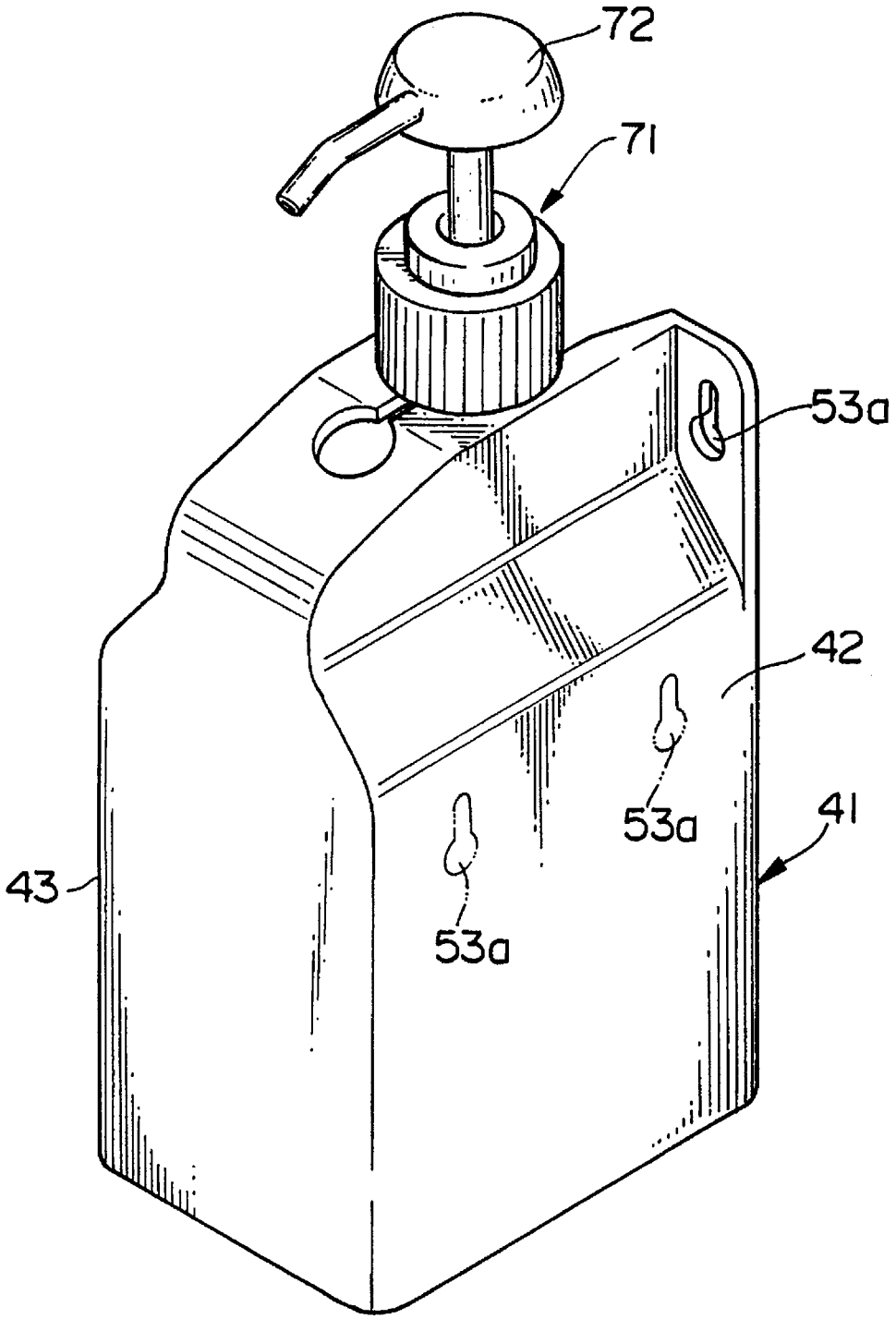
FIG. 7 is a perspective view showing a third embodiment of the present invention.

FIG. 7 shows a third embodiment of the present invention. In the third embodiment, the structure of the outer housing 41 is similar to that of the second embodiment, although the structure of the flexible inner container 1 is different from that of the second embodiment. In this embodiment, a flexible inner container with a dispenser 71 is used. In FIG. 7, the dispenser 71 projecting outside the outer housing 41 in the upward direction is attached to the mouth of the flexible inner container 1, passing through the hollow portion, and the contents such as a shampoo, can be dispensed by pumping the top 72 of the dispenser 71 with a finger while the container hangs on a wall.

When the contents of the flexible inner container 1 has been used up, after the container has been removed from the screws, pins or hooks 81 and 81, the empty inner container 1 is separated from the outer housing 41 by transferring the cylindrical mouth 11 to the large opening 47 along the guide notch 48. Thereafter, a new flexible inner container 1, filled with contents, is inserted into the outer housing 41. Then, the outer housing 41 with the new flexible inner container 1 in the side of the side wall 46 is grasped, and the outer housing 41 with the flexible inner container 1 is hung on the screws, pins or hooks 81 and 81 provided on a wall, through the holes 53*a* provided in the pair of projecting walls 53 and 53 or provided in the front wall 42 or the rear wall 43.

In the second and third embodiments, since the flexible inner container 1 is compactly inserted into the outer housing 41 leaving a small space between the front wall 42 of the outer housing 41 and the inner container 1, between the rear wall 43 and the container 1, and between the one side wall 46 and the container 1, and the inner side of the pair of guide portions 49 and 49 of the upper wall of the outer housing 41 are interfitted into the engagement grooves 14 and 14, movements of the inner container 1 in the forward and rearward directions, in the direction of the one side wall 46, and in the upper and lower directions, are controlled by the outer housing 41. Furthermore, since the large opening 47 is closed by a wall on which the container is hung by using a pair of screws or the like 81 and 81 and a pair of holes 53*a* and 53*a*, the inner container 1 cannot displace by a substantial amount in the outer housing 41 and cannot escape from the outer housing 41. Therefore, it is possible to stably attach the outer housing 41 having the inner container 1 therein to the wall and to stably handle the outer housing 41 in a state of the container being hung on a wall.

Since the front wall 42 and the rear wall 43 of the outer housing 41 have the inclined walls 42*a* and 43*a* which are corresponding to the inclined shoulder walls 2*a* and 3*a* of the flexible inner container 1 respectively, it is possible to further reduce the space between them to improve stability. Furthermore, since the upper wall 45 of the outer housing 41 has the inclined top surface 45*a*, when the contents of the container 1 is transferred into a pan or the like, it is possible to pour the contents into a pan or the like without spilling the contents, by bringing the inclined top surface 45*a* near or into contact with the pan or the like and inserting the hollow portion 16 into the above position inside the pan or the like.

According to the second and third embodiments, since the hole 51 connecting to the guide notch 48 through the slit 52 are provided adjacent the center of the inner end of the guide notch 48, the cylindrical mouth 11 of the flexible inner container 1 can be easily transferred to the predetermined position over the pair of stopper projections 50 and 50 when the flexible inner container 1 is inserted into the outer housing 41. Furthermore, if water enters into the outer housing 41 through the guide notch 48, the hole 51 or the like, in a shower room or the like, the water can be drained out through the plurality of through holes 44*a* formed in the bottom wall 44. When the container is used by placed on a table or a floor, it is possible to make the container difficult to slip by attaching the members 54 for preventing to slip into the through holes 44*a*, as shown in FIG. 6.

Figure 9:
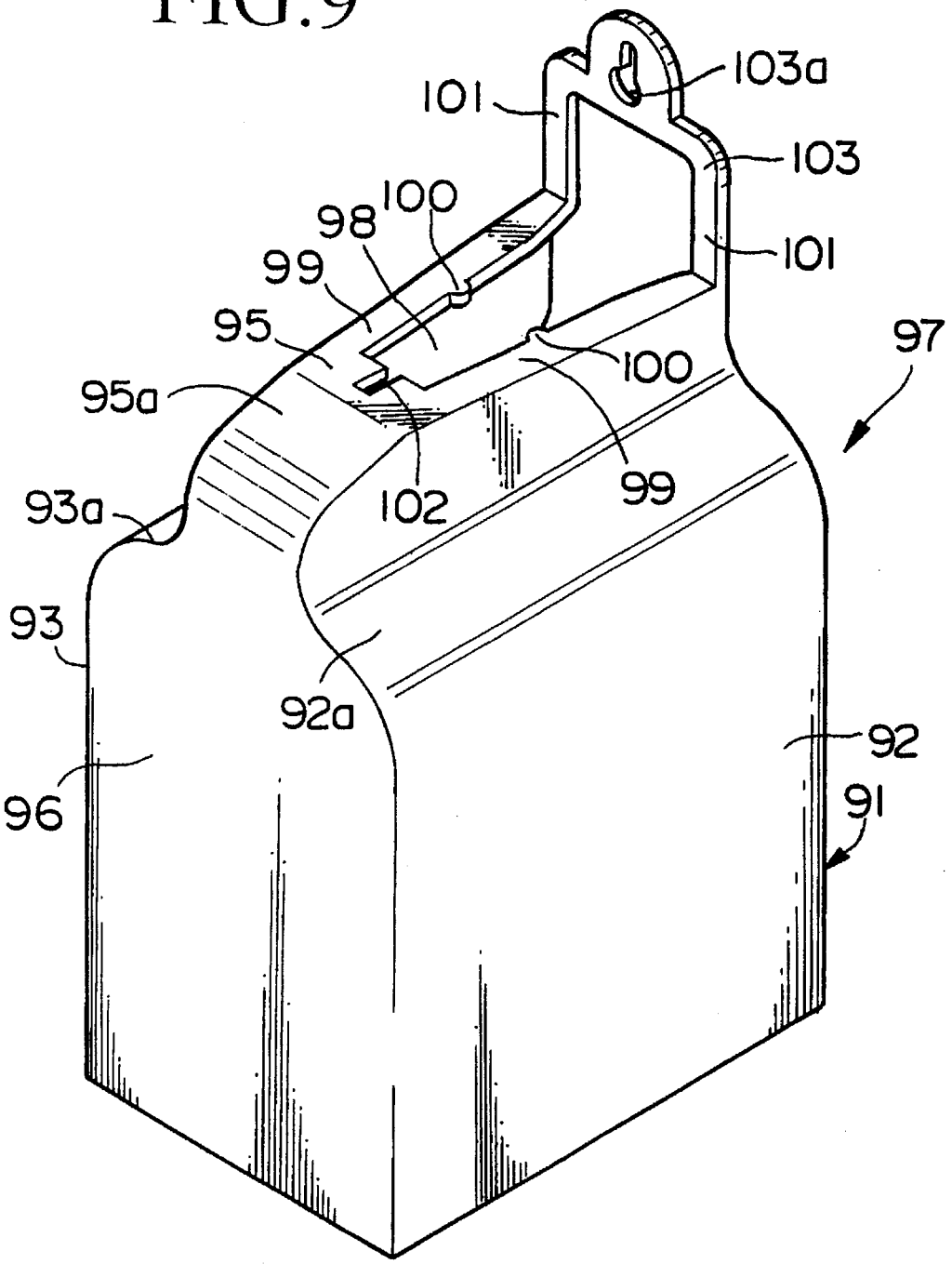
FIG. 9 is a perspective view showing a fourth embodiment of the present invention.

Next, a fourth embodiment of the container according to the present invention will be explained in detail in conjunction with FIG. 9, as follows. In the fourth embodiment, the same flexible inner container 1 as that of the first, second or third embodiment may be used. It is also possible to use either of an inner container having a dispenser and an inner container having no dispenser.

The outer housing 91 is made of a hard plastic or the like, and has a size and a shape into which the flexible inner container 1 can be completely inserted, similarly to that of the second or third embodiment of the present invention. The outer housing 91 comprises a front wall 92 and a rear wall 93 which are positioned in the long sides thereof, a bottom wall, an upper wall 95, and a side wall 96 which is positioned in one of the short sides thereof. The other side wall of the short sides of the outer housing 91 has a large opening 97. The upper wall 95 has a guide notch 98 which is open in the large opening 97 of the outer housing 91 and which extends to approximately the center portion of the outer housing 91. A pair of stopper projections 100 and 100 opposed to each other are provided on inner side of a pair of guide portions 99 and 99 of the upper wall 95 which sandwich the guide notch 98. The upper wall 95 in the side opposite to the large opening 97 has an inclined top surface 95*a*, in which the height of a position of the inclined surface 95*a* is smaller the smaller the distance between the position and the side wall 96 opposite to the opening 97 is. At a position of the upper wall 95 adjacent the center of the inner end of the guide notch 98, a slit 102 is formed so that the slit 102 facilitates elastic deformation of the outer housing 91 when the flexible inner container 1 is inserted into the outer housing 91.

The front wall 92 and the rear wall 93 of the outer housing 91 have two inclined walls 92*a* and 93*a* which have angles corresponding to that of the inclined shoulder walls 2*a* and 3*a* of the inner container 1, respectively. At the ends of the pair of guide portions 99 and 99 of the upper wall 95 in the side of the large opening 97, a pair of vertical member 101 and 101 which project to the upper vertical direction on the surface parallel to the opposite side wall 96 of the outer housing 91, is provided. The pair of vertical member 101 and 101 form a supporting member 103 and are joined to each other at a position above the center of the large opening 97. At approximately the center of the joined portion, a hole 103*a* is formed for hanging the container.

The flexible inner container 1 is inserted into the outer housing 91 through the large opening 97 thereof by interfitting the inner side of the pair of guide portions 99 and 99 of the upper wall of the outer housing 91 into the engagement grooves 14 and 14 of the flexible inner container 1 and transferring the cylindrical mouth 11 along the guide notch 98, similarly to the case of the first, second or third embodiment of the present invention. The cylindrical mouth 11 is transferred to the inner end of the guide notch 98 after passing the stopper projections 100 and 100. Consequently, the flexible inner container 1 is completely included in the outer housing 91. The cylindrical mouth 11 projects in the upward direction from the upper wall 95. Separation of the flexible inner container 1 from the predetermined position in the outer housing 91, i.e., from the inner end position of the guide notch 98, is prevented by the stopper projections 100 and 100. Thus, the flexible inner container 1 is stabilized in the outer housing 41 by hanging from the pair of guide portions 99 and 99 of the upper wall of the outer housing 91. Then, the outer housing 91 with the flexible inner container 1 in the side of the side wall 96 is grasped, and the supporting member 103 of the outer housing 91 is hung on a screw, a pin, or a hook provided on a wall, through the hole 103*a*.

In order to remove the container from the screw or the like provided on the wall, to dispense the contents of the flexible inner container 1, or to exchange the used up flexible inner container 1 for a new one filled with contents, a manner similar to that of the second or third embodiment of the present invention may be carried out.

The fourth embodiment of the present invention provides not only approximately the same effects as those of the second or third embodiment but also a very easy hanging of the container to the wall.

As explained above, the container of the present invention has a double structure so as to decrease the quantity of waste, in which a flexible inner container included in a hard outer housing is generally used only once and then thrown away and the hard outer housing is generally used repeatedly. The container does not have a dispenser and the contents is poured out by tilting the container. The flexible inner container is inserted into the outer housing through a large opening of the side wall thereof by interfitting the cylindrical mouth into the engagement grooves.

Accordingly, it is possible to very easily insert the flexible inner container into the outer housing independently of the shape or the softness of the inner container, and to stably hold the container erect.

In the present invention, since a supporting member for supporting the container which projects in the outward direction of the flexible inner container and is connected to the ends of the guide portions in the large opening is provided, it is possible to stably handle the outer housing having the inner container 1 contained therein, by grasping the supporting member or by hanging the container on a wall. The contents is dispensed from the opposite side of the supporting member through the hollow portion, and the contents do not adhere to the hand of a person handling the container. Therefore, it is possible to handle the container safely since the contents contained therein do not drip on the hand of the person holding the container.

What is claimed is:

1. A container comprising a combination of:

a flexible inner container which comprises a cylindrical mouth for dispensing contents of the container, in which the cylindrical mouth projecting in the upward direction is provided at the top of the flexible inner container, and the cylindrical mouth comprises a passage for communicating the inside and the outside of the container and engagement grooves provided on both sides of the outer periphery of the mouth with respect to the passage; and a hard outer housing which comprises four side walls one of which has a large opening, an upper substantially horizontal wall having a pair of guide portions sandwiching a guide notch which is opened to the large opening of the outer housing and extends to approximately the center of the outer housing, the upper wall further having an inclined surface in the side opposite to the opening in which the height of a position of the inclined surface is smaller the smaller the distance between the position and the side wall opposite to the opening is, each of the pair of guide portions having a stopper means for preventing separation of the flexible inner container from the place in the outer housing at a predetermined position facing the guide notch, and a supporting means for supporting the container in a substantially vertical position which projects in the outward direction of the container and which is connected to the ends of the guide portions in the side of the large opening; wherein the flexible inner container is inserted into the outer housing through the large opening of the outer housing and is held by the outer housing, by interfitting the pair of guide portions into the engagement grooves of the cylindrical mouth and projecting the mouth in the upward direction.

2. A container as claimed in claim 1, wherein the supporting means has a pair of ears which horizontally project in the outward direction of the large opening of the outer housing.

3. A container as claimed in claim 2, wherein each ear has a hole for laying a finger of a person.

4. A container as claimed in claim 1; wherein the flexible inner container is formed in a box-shape having a rectangle in a plan view by using flexible film material, and has a seal portion which is hermetically formed by joining the upper portions of the front and rear walls in the long sides of the rectangle, and a cylindrical mouth is attached at approximately the center of the seal portion.

5. A container as claimed in claim 1; wherein the flexible inner container comprises a plastic flexible film material, or a flexible film material made by laminating a metal foil, a paper, a cellophane, or a proper composition of them on a plastic film in a box-shape having a rectangle in a plan view by using flexible film material, and has a seal portion which is hermetically formed by joining the upper portions of the front and rear walls in the long sides of the rectangle, and a cylindrical mouth is attached at approximately the center of the seal portion.

6. A container as claimed in claim 4; wherein the cylindrical mouth of the flexible inner container comprises two tongue portions with pointed heads which horizontally project in outer opposite directions and are provided at the counter sides to each other with respect to the center of the mouth on the base portion thereof sandwiched by the seal portion, and the upper portions of the front wall and the rear wall of the container are hermetically joined to each other, to the side walls of the tongue portions, and to the peripheral wall of the cylindrical mouth.

7. A container as claimed in claim 4; wherein the cylindrical mouth of the flexible inner container comprises two flange portions with a little space which forms the engagement grooves, at portions above the joined portion.

8. A container as claimed in claim 4; wherein the flexible inner container has two inclined shoulder walls between the front wall and the joined portion, and between the rear wall and the joined portion respectively.

9. A container as claimed in claim 8; wherein the front wall and the rear wall of the outer housing have two inclined walls which are approximately parallel to the inclined shoulder walls of the inner container respectively.

10. A container as claimed in claim 1; wherein the supporting means comprises a pair of projecting walls which project from the ends of the guide portions in the side of the large opening in the outside direction of the container on a surface approximately parallel to the side wall of the outer housing opposite to the large opening, and at least a hole for hanging the container up on a wall is formed in the supporting means.

11. A container as claimed in claim 10; wherein the pair of projecting walls project to the lateral external directions opposite to each other, and each projecting wall has a hole for hanging the container up on a wall at approximately the center thereof.

12. A container as claimed in claim 10; wherein a pair of end portions of the supporting means in the large opening thereof project to the upward direction on the surface of the large opening of the outer housing and are joined to each other, and a hole for hanging up on a wall is formed at approximately the center thereof.

13. A container as claimed in claim 10; wherein a pair of holes for hanging the container up on a wall are formed in at least one of front and rear walls of the outer housing.

14. A container as claimed in claim 10; wherein a plurality of through holes for draining water out of the outer housing are formed in the bottom wall of the outer housing.

15. A container as claimed in claim 10; wherein a dispenser projecting outside the outer housing in the upward direction is attached to the mouth of the flexible inner container.

16. A container comprising a combination of:

a flexible inner container which comprises a cylindrical mouth for dispensing contents of the container, in which the cylindrical mouth projecting in the upward direction is provided at the top of the flexible inner container, and the cylindrical mouth comprises a passage for communicating the inside and the outside of the container and engagement grooves provided on both sides of the outer periphery of the mouth with respect to the passage; and a hard outer housing which comprises three side walls and a large opening, and an upper wall having a pair of guide portions sandwiching a guide notch which is opened in the direction of the large opening of the outer housing and extends to approximately the center of the outer housing, each of the pair of guide portions having a stopper means for preventing separation of the flexible inner container from the place in the outer housing at a predetermined position facing the guide notch; wherein the flexible inner container is inserted into the outer housing through the large opening of the outer housing and is held by the outer housing, by interfitting the pair of guide portions into the engagement grooves of the cylindrical mouth, and projecting the mouth in the upward direction.

17. A container as claimed in claim 16, wherein a slit is formed at a position of the upper wall adjacent the center of the end of the guide notch in the center side thereof so that the slit facilitates elastic deformation of the outer housing when the flexible inner container is inserted into the outer housing.

18. A container as claimed in claim 16, wherein the supporting means has a pair of ears which horizontally project in the outward direction of the large opening of the outer housing.

19. A container as claimed in claim 16; wherein the flexible inner container is formed in a box-shape having a rectangle in a plan view by using flexible film material, and has a seal portion which is hermetically formed by joining the upper portions of the front and rear walls in the long sides of the rectangle, and a cylindrical mouth is attached at approximately the center of the seal portion.

20. A container as claimed in claim 16; wherein a pair of end portions of the supporting means in the large opening project on the surface of the large opening of the outer housing, and a hole for hanging up on a wall is formed in a portion of the end portions.

21. A container as claimed in claim 16; wherein a pair of end portions of the supporting means in the large opening thereof project to the upward direction on the surface of the large opening of the outer housing and are joined to each other.

* * * * *

UNITED STATES PATENT AND TRADEMARK OFFICE

CERTIFICATE OF CORRECTION

PATENT NO. : 5,579,945

DATED : Dec. 3, 1996

INVENTOR(S) : Toru Ichikawa and Tomio Tahara

It is certified that error appears in the above-indentified patent and that said Letters Patent is hereby corrected as shown below:

On title page,

[73] Assignee: should read

--Hosokawa Yoko Co., Ltd., and
Kamaya Kagaku Kogyo Co., Ltd.,
Tokyo, Japan--

Signed and Sealed this

Fourth Day of November, 1997

Bruce Lehman

*Attest:*

BRUCE LEHMAN

*Attesting Officer*

*Commissioner of Patents and Trademarks*